US007603879B2

(12) United States Patent
Dauterive et al.

(10) Patent No.: US 7,603,879 B2
(45) Date of Patent: Oct. 20, 2009

(54) DEADBOLT VINYL GATE FENCE LOCK AND SYSTEM

(76) Inventors: LeRoy D. Dauterive, 2191 Emerson St., Terrytown, LA (US) 70056; Jerry G. Baker, 202 Greenwood St., Houma, LA (US) 70364

( * ) Notice: Subject to any disclaimer, the term of this patent is extended or adjusted under 35 U.S.C. 154(b) by 118 days.

(21) Appl. No.: 10/387,028

(22) Filed: Mar. 12, 2003

(65) Prior Publication Data

US 2004/0177659 A1 Sep. 16, 2004

Related U.S. Application Data

(60) Provisional application No. 60/421,758, filed on Oct. 28, 2002, provisional application No. 60/369,157, filed on Mar. 29, 2002, provisional application No. 60/365,134, filed on Mar. 16, 2002.

(51) Int. Cl.
*E05B 9/0849* (2006.01)

(52) U.S. Cl. ..... 70/106; 49/394; 70/110; 70/134; 70/370; 70/451; 70/452; 70/449; 70/DIG. 60; 292/337; 292/DIG. 13; 292/DIG. 53

(58) Field of Classification Search ..... 70/106, 70/110, 134, 370, 451, DIG. 60, 449, 381, 70/452, 466, DIG. 35, DIG. 63; 49/394, 49/501; 292/337, 356, 357, DIG. 13, DIG. 53
See application file for complete search history.

(56) References Cited

U.S. PATENT DOCUMENTS 714,954 A * 12/1902 Setbacken ..... 292/54
1,087,839 A * 2/1914 Segal ..... 70/106
2,638,370 A * 5/1953 Price ..... 292/106
3,890,813 A * 6/1975 Cothron ..... 70/92
3,906,759 A * 9/1975 Schwing et al. ..... 70/128
4,451,072 A * 5/1984 Petty, Sr. ..... 292/128
4,536,022 A * 8/1985 Giordano ..... 292/228
4,993,759 A * 2/1991 Thomas ..... 292/235
5,024,473 A * 6/1991 McQuade ..... 292/120
5,103,658 A * 4/1992 McQuade ..... 70/77
5,765,411 A * 6/1998 Rowan ..... 70/101
7,201,030 B2 * 4/2007 Timothy ..... 70/101
7,347,069 B2 * 3/2008 Talpe ..... 70/107

* cited by examiner

*Primary Examiner*—Lloyd A Gall
(74) *Attorney, Agent, or Firm*—Garvey, Smith, Nehrbass & North, L.L.C.; Seth M. Nehrbass

(57) ABSTRACT

The present invention is an apparatus of joined parts that allows the locking of a gate framed in vinyl parts to a stationary post made of vinyl. The stationary vinyl post is typically hollow with the walls of the post being typically of a thickness of no more than ⅜of an inch and the outer diameter of the gate framing and post typically ranging from 3½inches by 3½inches square to 5 inches by 5 inches square in size. The apparatus includes a kit where round or square or rectangular cups that have overlapping top flanges and are inserted into and fit snugly in holes drilled or cut into the sides of a hollow vinyl fence post. The cups are configured to accept the installation of standard home deadbolt locks. The lock of the present invention can be made of moldable materials such as plastics and metals and will use commonly available deadbolt locks snugly fitted together with other parts of the invented apparatus to form the invention and a system to use available standard deadbolt locks to lock and unlock fence gates.

18 Claims, 15 Drawing Sheets

KEYED CUP GATE LOCK
Patent Pending

INSTALLATION INSTRUCTIONS

FIG. 13 A

Note: Gate Lock cups and deadbolt are to be installed on stationary fence post: standoff receiver to be installed on gate. Fence post metal insert no higher than 30" to allow drilling of holes in post.

STEP 1
DRAW LEVEL LINE ON FENCE POST USING SPEED SQUARE (See Figure 1)

Note: Check local code for minimum heigth of lock installation and gate reenforcement required for locking swiming pool areas STEP 2
MARK CENTER OF 1" HOLE FOR DEADBOLT CYLINDER 2 INCHES FROM OUTSIDE EDGE OF FENCE POST (See Figure 2)

STEP 3
DRILL 1 INCH HOLE FOR DEADBOLT CYLINDER CENTERED ON MARKED HOLE POSITION (See Figure 2)

STEP 4
SLIDE GASKET ON DEADBOLT CYLINDER AND INSTALL DEADBOLT CYLINDER IN 1 INCH HOLE USING SCREWS (See Figure 3)

STEP 5
MEASURE 2 3/8 INCHES FROM SIDE WITH DEADBOLT CYLINDER AND MARK ON LEVEL LINE (See Figure 3)

FIGURE 1

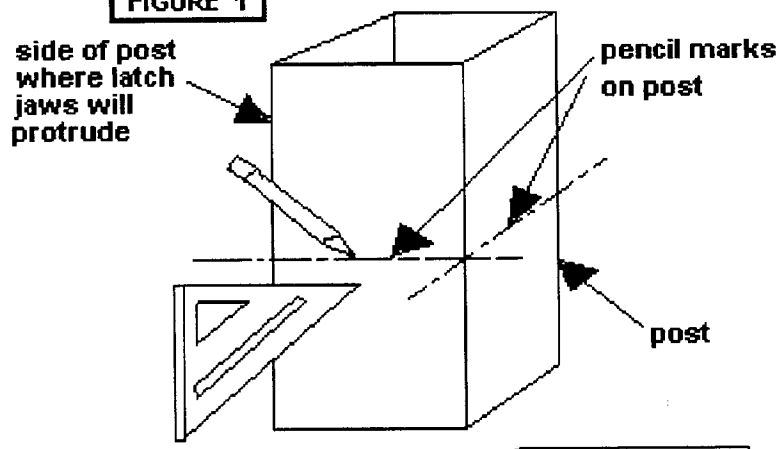

FIGURE 2

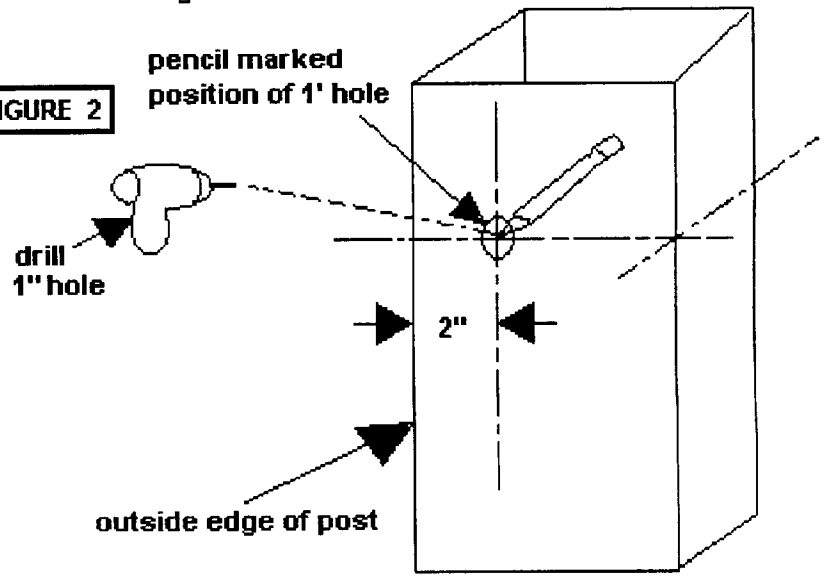

FIG. 13 B

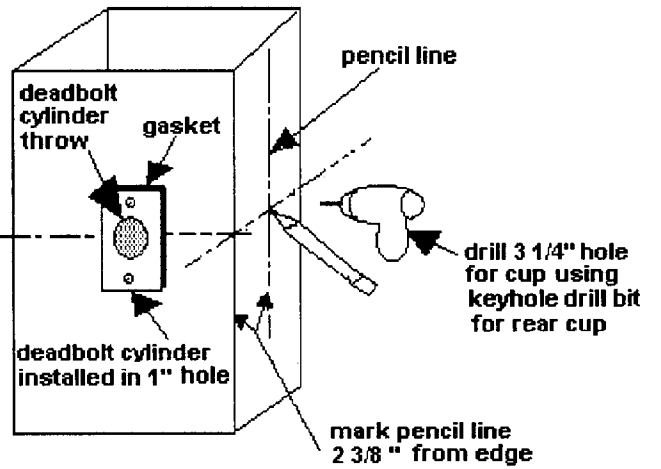

FIGURE 3

STEP 6
DRILL 3 1/4 INCH OD HOLE CENTERED ON 2 3/8 INCH MARK (See Figure 3)

STEP 7
INSTALL CUPS INTO 3 1/4 INCH HOLES (See Figure 4)

STEP 8
INSTALL DEADBOLT FACEPLATES AND TUMBLERS INTO CUPS FOLLOWING INSTRUCTIONS INCLUDED WITH DEADBOLT. (See Figure 5) (Note: USE THREADED RODS TO ALIGN DEADBOLT LOCK PARTS AND REPLACE EACH ROD WITH A THREADED BOLT USED TO CONNECT DEADBOLT LOCK PARTS)

STEP 9
INSTALL LATCH ON FENCE POST OVER THROW OF DEADBOLT CYLINDER USING SCREWS (See Figure 5)

STEP 10
INSTALL LATCH'S STRIKE BAR USING SCREWS (See Figure 5)

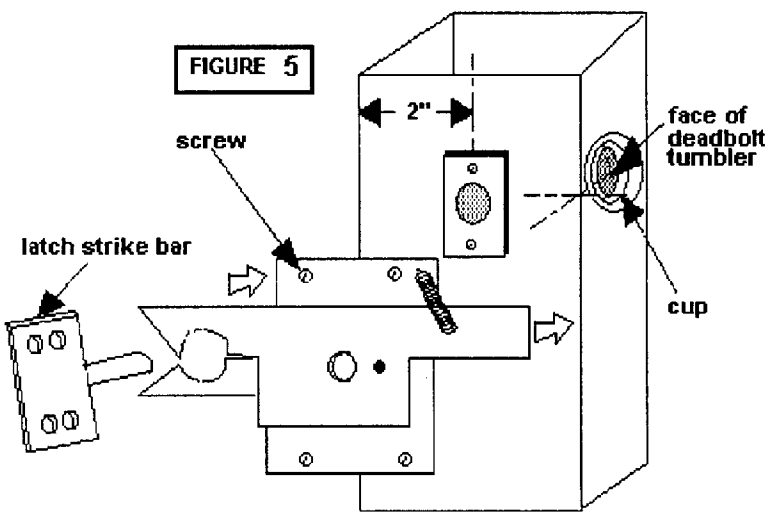

FIGURE 5

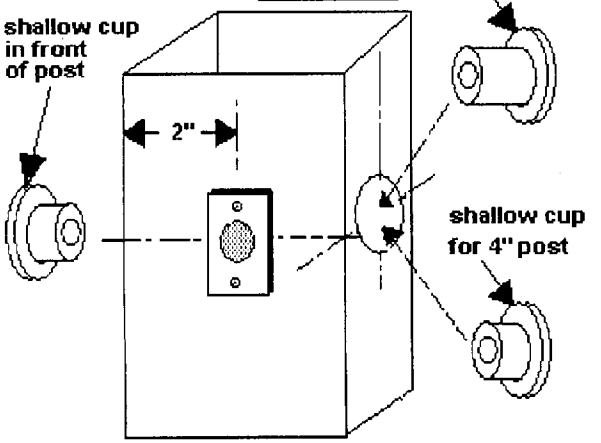

FIGURE 4

Deadbolt Locks Imported by Black and Decker
To Replace Defective Locks Call 1-800-329-LOCK

FIG. 25 A

KEYED GATE LOCK WITH
STANDOFF RECEIVER
Patent Pending
INSTALLATION INSTRUCTIONS

Note: Gate Lock cups and deadbolt are to be installed on stationary fence post: standoff receiver to be installed on gate. Fence post metal insert no higher than 30" to allow drilling of holes in post.

STEP 1
DRAW LEVEL LINE ON FENCE POST
USING SPEED SQUARE (See Figure 1)

Note: Check local code for minimum heigth of lock installation and gate reenforcement required for locking swiming pool areas STEP 2
MARK POSITION OF 1 " HOLE FOR DEADBOLT CYLINDER ON SIDE OF FENCE POST (See Figure 2)

STEP 3

DRILL 1 INCH HOLE FOR DEADBOLT CYLINDER CENTERED ON MARKED HOLE POSITION (See Figure 2)

STEP 4

SLIDE GASKET ON DEADBOLT CYLINDER AND INSTALL DEADBOLT CYLINDER IN 1 INCH HOLE USING SCREWS (See Figure 3)

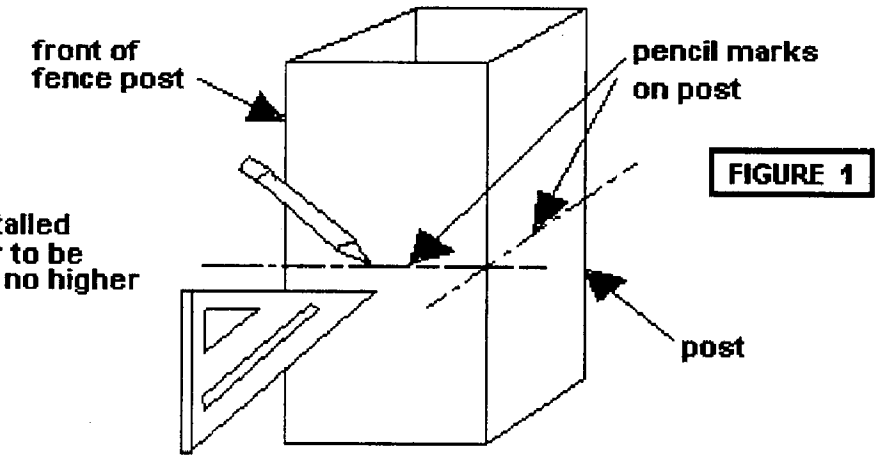

FIGURE 1

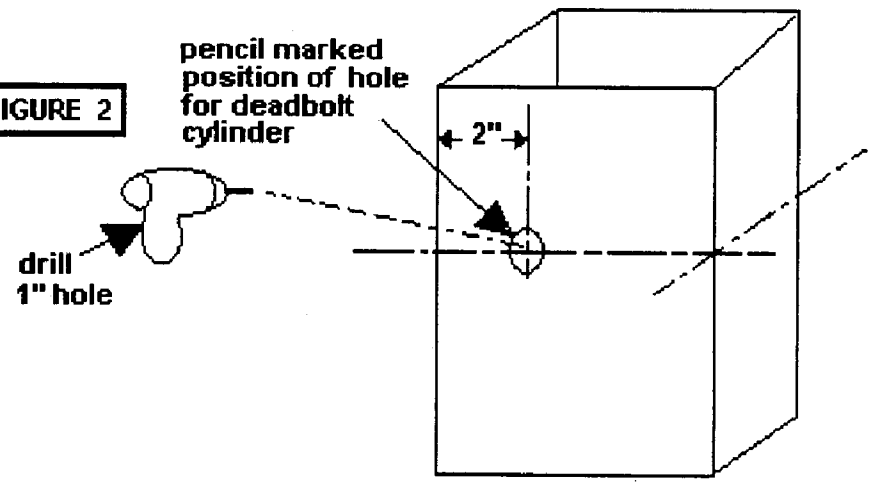

FIGURE 2

FIG. 25 B

STEP 5

MEASURE 2 3/8 INCHES FROM SIDE WITH DEADBOLT CYLINDER AND MARK ON LEVEL LINE (See Figure 3)

STEP 6

DRILL 3 1/4 INCH OD HOLES CENTERED ON 2 3/8 INCH MARK (See Figure 3)

STEP 7

INSTALL CUPS INTO 3 1/4 INCH HOLES (See Figure 4)

STEP 8

INSTALL DEADBOLT FACEPLATES AND TUMBLERS INTO CUPS FOLLOWING INSTRUCTIONS INCLUDED WITH DEADBOLT. (See Figure 5) (Note: USE THREADED RODS TO ALIGN DEADBOLT LOCK PARTS AND REPLACE EACH ROD WITH A THREADED BOLT USED TO CONNECT DEADBOLT LOCK PARTS)

STEP 9

ON GATE INSTALL STANDOFF RECEIVER ALIGNING RECEIVER HOLE WITH THROW FROM DEADBOLT CYLINDER (See Figure 5)

FIGURE 3

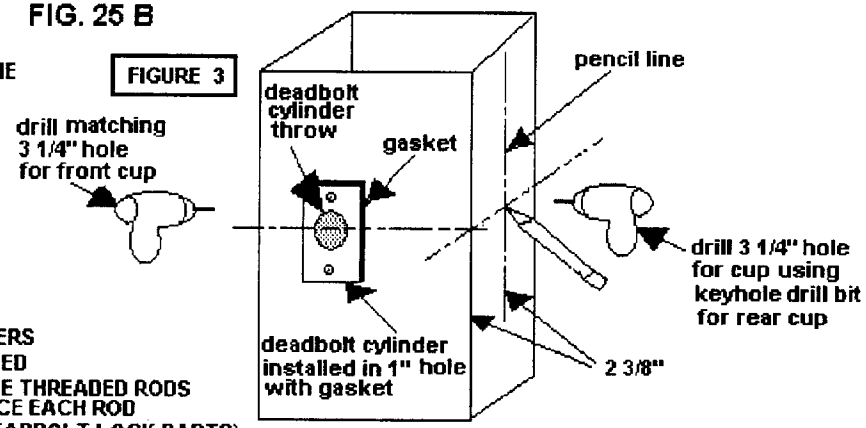

FIGURE 4

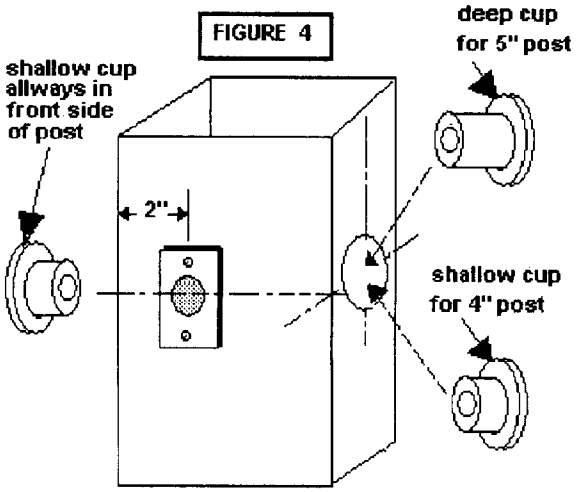

FIGURE 5

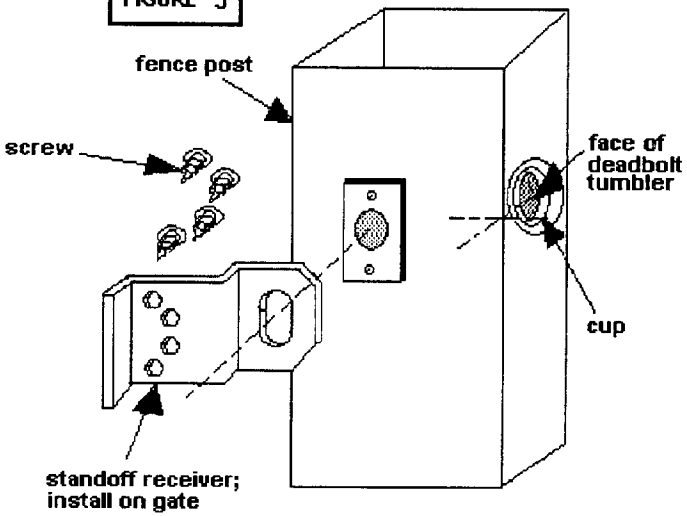

Deadbolt Locks Imported by Black and Decker
To Replace Defective Locks Call 1-800-327-LOCK

FIG. 33

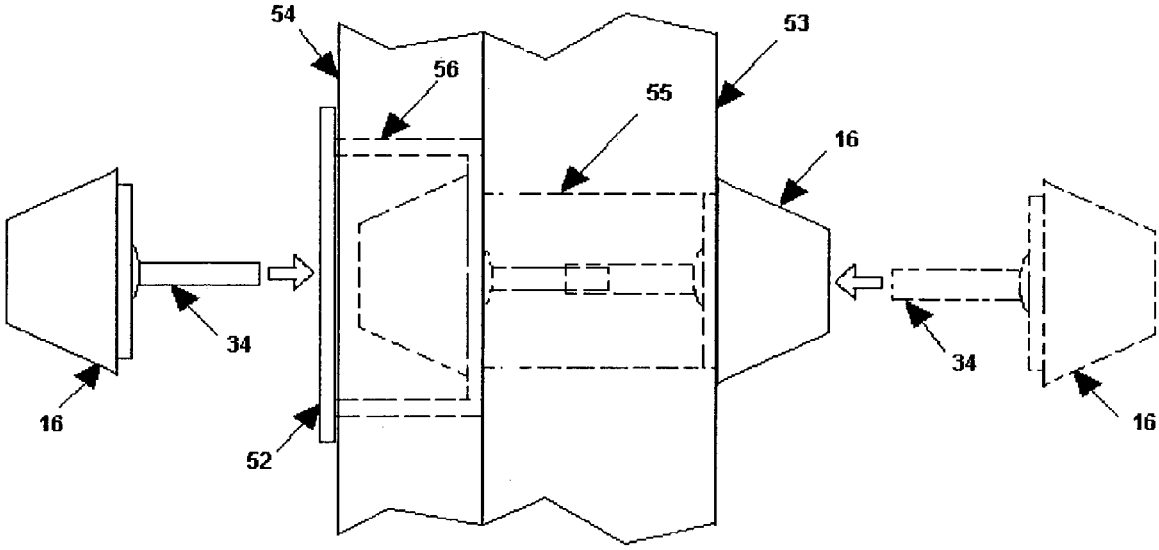

FIG. 34

WOOD FENCE LOCK
INSTALLATION INSTRUCTIONS

1. MARK CENTER OF HOLE FOR DEADBOLT AS DIRECTED BY DEADBOLT INSTALLATION INSTRUCTIONS; USE SHORTEST CENTERING (i.e. 2 3/8")
2. DRILL 1/8 " PILOT HOLE COMPLETELY THROUGH A 2 X 4 GATE FRAME BOARD INSTALLED ON THE OUTER END OF THE GATE FRAME(i.e. INSTALLED ON END WITHOUT HINGES) AND THE FENCE BOARD
3. DRILL A 3 1/4" HOLE THROUGH THE FENCE BOARD
4. DRILL A 2 1/8" HOLE THROUGH THE GATE FRAME BOARD
5. DRILL 1 " HOLE FOR DEADBOLT CYLINDER AS DIRECTED IN DEADBOLT INSTALLATION INSTRUCTIONS
6. INSTALL CUP
7. SLIDE FACE PLATE GASKET UNDER DEADBOLT CYLINDER FACEPLATE
8. INSTALL DEADBOLT LOCK AS DIRECTED BY DEADBOLT LOCK INSTRUCTIONS
9. INSTALL DEADBOLT RECEIVER ON OPPOSING FENCE POST OR BOARD TO RECEIVE THROW FROM DEADBOLT

DEADBOLT VINYL GATE FENCE LOCK AND SYSTEM

SPECIFICATION STATEMENT AS TO RIGHTS TO INVENTION MADE UNDER FEDERALLY-SPONSORED RESEARCH AND DEVELOPMENT

The invention was not created as a result of federally sponsored research and development.

INCLUSION OF PRIOR ART AND DOCUMENTATION

This application is in furtherance of:

Disclosure Documents 486766 filed Jan. 3, 2001 titled "KEY LOCK FOR PLASTIC FENCING";

500159 filed Sep. 20, 2001 titled "VINYL FENCE GATE DEADBOLT LOCK";

Via US Post Office Priorty Mail Oct. 1, 2001 titled "VINYL FENCE GATE DEADBOLT LOCK WITH COUPLER";

506245 dated Feb. 28, 2002 titled "VINYL FENCE GATE DEADBOLT LOCK WITH LATCH";

506426 dated Mar. 4, 2002 titled "VINYL FENCE DEADBOLT LOCK WITH LATCH AND CUPS";

509331 filed Apr. 4, 2002 titled "ONE PIECE FENCE LOCK CUP"

And claims priority of the following U.S. provisional patent applications:

60/263,227 titled "KEYED LOCK APPARATUS FOR PLASTIC FENCING" filed Jan. 23, 2001;

60/344,598 titled "VINYL FENCE GATE DEADBOLT LOCK WITH COUPLER" filed Oct. 29, 2001;

60/359,257 titled "VINYL FENCE DEADBOLT LOCK WITH LATCH AND CUPS" filed Feb. 22, 2002;

60/365,134 filed Mar. 16, 2002 titled "COMBINED FENCE LOCK WITH LATCH AND CUPS"

60/369,157, filed 29 Mar. 2002 titled "FENCE DEADBOLT LOCK COMBINED WITH LATCH AND CUPS"

60/421,758, filed 28 Oct. 2002 titled "DEADBOLT VINYL GATE FENCE LOCK AND SYSTEM"

All are incorporated into this patent application by this reference.

BACKGROUND OF THE INVENTION

The invention, DEADBOLT VINYL GATE FENCE LOCK AND SYSTEM, is an apparatus of joined parts that allows the locking of a gate framed in vinyl parts to a stationary post made of vinyl. The stationary vinyl post is typically hollow with the walls of the post being typically of a thickness of no more than ⅜ of an inch and the outer diameter of the gate framing and post typically ranging from 3 ½ inches by 3 ½ inches square to 5 inches by 5 inches square in size. Sometimes the inside walls of the fence posts are lined with a metal sleeve for strength but the interior remains hollow. The gate's framing is typically made of vinyl framing members that have an outer thickness from 1 inch to 5 inches. The gate frames are also typically hollow inside the walls of the framing members with the walls of the gate framing being typically of a thickness of approximately ⅛ of an inch. Sometimes the inside walls of the gate framing are lined with joined metal sleeves for strength. The gate framing is connected to a second stationary fence post with hinges. The invented lock can be mounted to either a gate frame or to a fence post dependent upon thickness of each, however, the preferred installation calls for the deadbolt lock and cup or cups to be installed in the stationary fence post that does not have hinges.

The gate and fencing is made of vinyl materials as vinyl materials are not subject to damage by termites, insects and/or water damage as is wood fencing materials and are color fast.

The invented lock apparatus will be made of moldable materials such as plastics and metals and will use commonly available deadbolt locks snugly fitted together with other invented apparatus to form the invention and a system to use available deadbolt locks to lock and unlock fence gates.

This invention addresses the need for a key operated vinyl fence gate lock easy installable by homeowners of ordinary skills that uses commonly available deadbolt locks.

Prior Art

Preliminary research of patents issued did not identify the existence of any prior art that incorporates all of the conjoined components of this invention. Prior art identified as relevant are listed below.

| | | | |
|---|---|---|---|
| 4,565,079 | Robert J. Smith | Gate Lock | Jan. 21, 1986 |
| 5,024,473 | Donald E. McQuade | Gate Lock | Jun. 18, 1991 |
| 5,103,658 | Donald E. McQuade | Gate Latch | Apr. 14, 1992 |
| 5,257,519 | J. Claton Miller, III | Gate Lock | Nov. 2, 1993 |
| 5,588,314 | Anthony D. Knezovich | Gate Lock | Dec. 31, 1996 |
| 5,765,411 | William Rowan | Fence Lock | Jun. 16, 1998 |
| 6,192,723 | Richard G. Brownell, Sr. | Gate Lock | Feb. 27, 2001 |
| 6,227,019 | Kn Singh Chhatwal | Gate Lock | May 8, 2001 |

U.S. Pat. No. 4,565,079 discloses a deadbolt on a gate.

U.S. Pat. No. 5,024,473 discloses using a deadbolt to prevent a gate latch from being moved.

U.S. Pat. No. 5,103,658 discloses a deadbolt in combination with a grate that extends to prevent the fork latch from moving. (See lock plug shafts 146, 148 in FIGS. 5-7.)

No prior art was found that addressed the existing need to lock and unlock a vinyl gate from both sides of the gate in the manner addressed by the invented keyed lock apparatus described herein. Further, there was no lock mechanism found in research of lock manufacturers sales catalogues and telephone contacts with lock manufacturers and sales outlets that was designed and sized to solve the operational and installation specifications of the invented gate lock apparatus described herein.

Moreover, in the patent search for this application, no other prior art was identified which singularly incorporated all the specific improvements and engineering design specified herein for the intended purpose of the invention i.e. to provide a practical system of components that can be easily installed (and removed if necessary) by individuals of the general public, contractors, and others with limited skills, that makes it possible to fabricate a gate having framing members from 1 inch to 5 inches thick in combination with a stationary fence post that can be from 3 ½ inches square to 5 inches square that are made of vinyl, that can be locked and unlocked from both sides of the gate using a keyed standard house deadbolt lock.

Analysis of the invented structure and design of the prior art uncovered the following facts:

1. Although some parts of the design of the invented system have been in existence in the cited prior art for a great number of years, individuals expert and particularly knowledgeable in the field of designing and manufacturing locks for gates for fencing have not produced or designed a gate locking and unlocking apparatus to address the purpose of the design of the invented system, therefore, it can be stated that the subject matter of this application is not obvious to a person of ordinary skill in the art if those individuals who are expert in the art have not conceived the subject system described herein.

2. Although prior art has some of the related segments of the invention none singularly have overcome their deficiencies of size, parts, and/or assembly that are solved by the invented apparatus.

Specifically, prior art does not provide for a comprehensive conjoined component solution to the problems of providing a practical and decoratively finished gate lock system that is easy to install in vinyl fence posts that are typically 4 inch by 4 inch or 5 inch by 5 inch square and hollow.

SUMMARY OF THE INVENTION

The field of art of the invention is locking mechanisms for gates for vinyl fencing The invention is preferably the combination of a standard deadbolt lock, cup or cups, used in combination with a standoff receiver with a hole or a gate latch with a hole aligned to receive the throw of a standard deadbolt lock with said deadbolt lock preferably being operable on one or both sides using a key; said apparatus is intended for use in stationary fence posts to affix gates that are framed of hollow vinyl members that are 1 inch to 5 inches thick.

The invention is a deadbolt lock installable with a cup or cups to utilize a latch apparatus or deadbolt lock throw receiver and system that can be operable on one or both sides using a key or other means with said apparatus that is intended for use in stationary fence posts or in gates that are framed of hollow vinyl members that are typically hollow and 4 inches by 4 inches or 5 inches by 5 inches in diameter.

The invented apparatus is an assembly of unique and commonly available parts designed to be put together in the hollow vinyl gate post and adjacent vinyl gate framing to provide a means of connecting the post and framing with a device that can be locked and unlocked from each side of the gate, with at least one side being lockable using a key or other means.

The device will be made of plastics and/or metal parts sized and designed to affix one to another to form the complete lock. The invention may have alternate embodiments that will accomplish the same purpose—to lock or unlock a fence gate from ether side of a gate by use of a keyed tumbler or a thumb turn to extend or retract the throw of a deadbolt lock mechanism in an internal or external hole.

A kit includes a deadbolt lock commonly sold for installation in home entry doors, a cup or cups to provide a means to install the deadbolt lock; a throw or throw receiver or a spring operated latch commonly sold to affix fence gates to fence posts, the latch possibly having a hole to receive the throw of the deadbolt mechanism, instructions to indicate where holes must be cut in 4 inch by 4 inch or 5 inch by 5 inch gate or fence framing, and instructions for installing the lock mechanism.

BACKGROUND OF INVENTION

Individuals who purchase vinyl fencing must fabricate an individual special lock or use a padlock and apparatus to lock a gate in vinyl fencing on one side of the fencing.

Commonly available home deadbolts locks do not fit the width of 4 inch and 5 inch square hollow fence parts as they are made to fit 1 ¼ inch to 1 ¾ inch wide standard house doors.

The invented gate lock has been devised to provide preferably a key operated lock that can be locked and unlocked on both sides of a vinyl fence gate combined with an operable spring latching mechanism. The invented gate lock renders the latch mechanism inoperable by use of a key and/or a thumb turn thereby locking a gate in place.

The invented gate latch lock is based upon making adaptations to existing parts and possibilities in combinations not obvious to persons of skill in fence lock systems.

The inventors noted that standard deadbolt locks fit into doors from 1 ¼ inches thick to doors 1 ¾ inches thick (i.e. a ½ inch expansion capability).

To accommodate the installation of standard deadbolt locks in hollow 5"×5" and 4"×4" square vinyl posts, the inventors fabricated cups sized to fit into holes in each side of said vinyl posts sized to reduce the distance between the backs of the cups to the 1 ¼ inch to 1 ¾ inch spacing required to install standard deadlock locks and to also align the throw coming from an installed deadbolt lock with a hole in a gate latch or a hole in a throw receiver wherein the extended throw in the latch's hole will render the latch inoperable or catch in the hole of the throw receiver.

At the time of submission of prior provisional patents and disclosures there was no key lock apparatus that used a standard door deadbolt lock such as the lock made for the Kwikset division of the Black and Decker Corporation that could be readily installed into the 4 and 5 inch square hollow parts used to make vinyl fence posts.

Advantages of the Invention

The advantages of the invention differing from prior art are that:

1. The invented apparatus is designed to use a cup or 2 cups sized to allow the installation of standard deadbolt locks into the width (e.g. typically 4 inches by 4 inches and 5 inches by 5 inches square) of hollow vinyl fence posts and gate framing used for vinyl fencing.
2. The invented apparatus incorporates the use of commonly available double and single deadbolts thereby saving the tooling of the key operated deadbolt and also making the changing and keying of the deadbolt locks universal throughout the United States.
3. The invented apparatus incorporates the use of a gate latch with a hole to lock a gate.
4. The invented apparatus incorporates the use of a standoff receiver with a hole to lock a gate.
5. The invented apparatus makes it possible to have a vinyl fence gate that is lockable using a key either on one side or on both sides of the gate
6. The invented apparatus makes it possible to use the same key to open a house door and a fence gate.
7. Installation of the invented apparatus requires no special tools.
8. The invented apparatus is designed to be easily installed and removed by persons of ordinary skills.
9. The invented apparatus gives the general public and contractors an option that does not presently exist that is to install a prefabricated keyed lock apparatus in vinyl fence gates that can operable from both sides of a gate using a key or configured to be key operable from one side and optionally thumb turn operable from the other side of the gate.
10. The invented apparatus preferably uses a cup or a pair of cups to facilitate the mounting of a standard home door deadbolt mechanism.
11. The invented apparatus can be installed in a one cup embodiment on a standard wood fence gate to lock fence gates made of wood.

12. The invented apparatus can be installed in a one cup embodiment on a hollow vinyl fence post or gate frame typically 4 inches by 4 inches to 5 inches by 5 inches square to allow the installation of a standard deadbolt lock to lock fence gates.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 13A shows steps 1 to Step 5 of the instructions for installing the invented gate lock with a latch with a hole.

FIG. 13B shows steps 6 to Step 10 of the instructions for installing the invented gate lock with a latch with a hole.

FIG. 25A shows Step 1 to Step 4 of typical installation instructions for the embodiment of the invented lock that uses a standoff receiver as a means to affix a gate to an opposing fence post.

FIG. 25B shows Step 5 to Step 9 of typical installation instructions for the embodiment of the invented lock that uses a standoff receiver as a means to affix a gate to an opposing fence post.

FIG. 33 shows a side view of parts of the invented wood gate lock.

FIG. 34 shows the typical installation instructions for the invented wood gate lock.

DESCRIPTION OF INVENTION

The invented apparatus includes a kit where cups (e.g. approximately 3 ¼ inches in diameter) that have overlapping top flanges of at least ⅛ inches wide are inserted into and fit snugly in holes drilled into the sides of a hollow vinyl fence post with the top flange of each cup (i.e. lip of the cup) overlapping and preventing the cups from being drawn through the holes; said cups being deep enough to accept the installation of standard home deadbolt lock mechanisms that are designed to be installed on 1 ¼ inch to 1 ⅞ inch thick doors, and where the deadbolt lock throw is installed to extend through a parallel hole of approximately 1 inch in diameter in the side of the fence post opposite from the gate framing, and where the throw when extended from the deadbolt lock is aligned to 1) fit into a hole existing in a spring operated gate latch to prevent the gate latch from opening when the throw is extended through the hole in the latch by use of a key or thumb turn, or 2) fit into a hole in a throw receiver, or 3) over/under the handle of a gate latch, thereby rendering a fence gate that can be locked and unlocked from each side of the gate, with preferably at least one side being lockable using a key.

Components of the Invention

The components of the preferred embodiment of the invention include preferably:

1. Deadbolt Lock

A double or single cylinder lock, operable with a key, commonly manufactured by companies such as the Kwickset Division of the Black and Decker Corporation, designed and sized to be installed into the exterior doors of houses; said deadbolt locks are sold at hardware stores and chain stores such as Home Depot, Inc. and Lowes Home Improvements, Inc.; further said locks having a cylinder containing a throw that can be extended and retracted herein referred to as the throw of the deadbolt lock.

Figure 6:
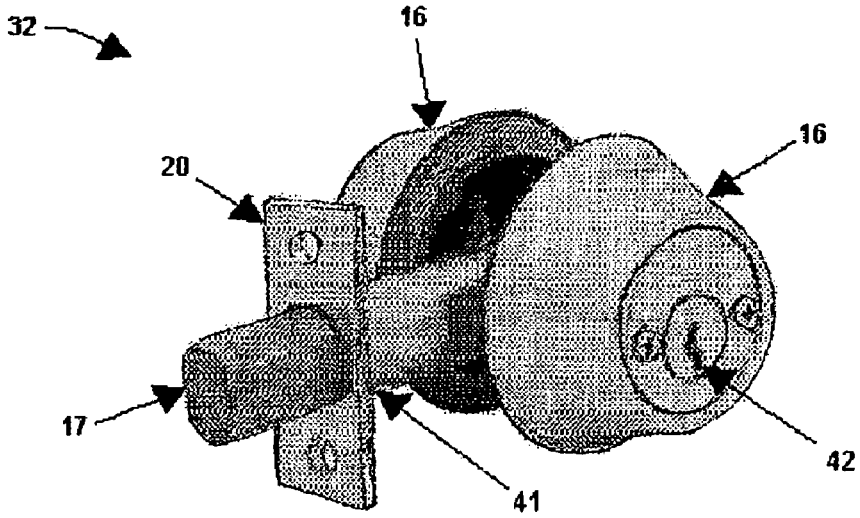
FIG. 6 (Prior Art)
FIG. 6 shows a profile view of an assembled deadbolt lock that is commonly available from such vendors as the Kwickset Corporation.

See FIG. 6.

2. Deep Cup.

A round (or square or rectangular) flanged cup approximately 2 ¼ inches deep outside diameter and sized to fit in a hole approximately 3 ¼ inches in diameter to reduce the distance to an outside edge of a post to allow the normal installation of a deadbolt lock in a 5 inch square post when matched with a shallow cup. See FIGS. 4 and 5B.

3. Shallow Cup.

A round (or square or rectangular) flanged cup approximately 1 ¼ inches deep outside diameter and sized to fit in a hole approximately 3 ¼ inches in diameter to reduce the distance to an outside edge of a 4 inch by 4 inch square post to allow the normal installation of a deadbolt lock in a 4 inch when 2 shallow cups are installed or for a 5 inch square post when 1 shallow cup and 1 moderately deep cup are installed. See FIGS. 4 and 5A.

4. Extra Deep Cup.

A round (or square or rectangular) flanged cup preferably approximately 3 ½ inches deep sized outside diameter and sized to fit into a larger hole such as 4 ¼ inches in diameter to reduce the distance to an outside edge of a post to allow the normal installation of a deadbolt lock in a 5 inch square post. See FIGS. 26, 27, 28, and 29.

5. Gate Latch With Hole.

A side mounted spring operable gate latch with a hole sized to fit and receive the deadbolt lock's throw. See FIGS. 2 and 9.

6. Standoff Receiver

A plate with a hole sized to receive a throw coming from a deadbolt lock; said plate with screw holes aligned in the first 1 ½" of width to allow the plate to be fasten to gate frames as small as 1 ½ inch thick with the hole in the plate being always at the same distance from the front edge of the gate frame to align with the deadbolt lock throw, and further, said hole being oval in shape to allow for minor settling of a gate due to subsidence in soils. See FIGS. 15, 16, 17, and 18.

7. Oval Receiver

A receiver with a hole that is oval in shape sized to receive the throw of a deadbolt lock that is affixed to the opposing gate frame to physically affix a fence post to a gate frame. See FIGS. 23 and 24.

8. Throw Gasket

A bushing with an inset flange designed with a hole sized to cover the edges of the face plate of the throw of a standard deadbolt lock to provide for the faceplate being away from the face of a post. See FIGS. 19, 20, 21, and 22.

9. Wood Fence Gate Cup.

A flanged cup approximately ¾ inches deep outside diameter and sized to fit in a hole approximately 3 inches in diameter to reduce the distance to an outside edge of a post to allow the normal installation of a deadbolt lock in the combined width of a wood fence board attached to fence gate framing; said combination being of approximately 2 ⅛ inches thick. See FIGS. 30, 31, 32, and 33.

10. Installation Instructions

Instructions detailing the steps to install the invented lock and latch parts. See FIGS. 13A, 13B, 25A, and 25B.

11. Kit Packaging

A box or bag containing all of the above parts and optionally two threaded rods of the same thread size as the threaded deadbolt lock bolt (e.g. typically 8/32 threaded rods) to facilitate the installing the deadbolt lock into the cups or cup.

EMBODIMENTS OF THE INVENTION

The preferred embodiments of the invention were determined as described below.

Two Cups Embodiments

Typical Purpose: For New Vinyl Fence Gates Without Installed Latches

Embodiment 1

A kit containing, a standard deadbolt lock, 2 cups and a gate latch with a hole aligned to receive the throw of the deadbolt lock Typical Purpose: For Existing Vinyl Fence Gates With Installed Latches

Embodiment 2

A kit containing a standard deadbolt lock, 2 cups, and a standoff receiver with a hole aligned to receive the throw of the deadbolt lock and optionally a throw gasket to provide a finished appearance to the exposed deadbolt cylinder face plate.

This is not to say that the preferred embodiments are the only way to combine components of the invention or the only combination of components that will achieve the intent of the invention (i.e. to be able to use a standard deadbolt lock to lock and unlock a fence gate from one or both sides). For example one cup embodiments can be made using the parts of the invention such as:

Embodiment 3

A kit containing a standard deadbolt lock, a single cup to fit a deadbolt lock into a wood fence gate, and optionally but not necessarily having an oval receiver to receive the throw of the deadbolt lock.

Embodiment 4

A kit containing a standard deadbolt lock and a single cup to fit a deadbolt lock into hollow vinyl fence posts being optionally used with a gate latch without a hole or an oval receiver or other device to receive the throw of a deadbolt lock.

It is to say that the preferred embodiments appear to be the more logical and easily installed combination of parts that will make it possible to lock fence gates of different thickness (e.g. 2 inches, 3 inches, 3 ¾ inches, 4 inches, 4 ¾ inches and 5 inches) with fence posts ranging from 3 ¾ inches to 5 inches square using one of the preferred embodiments of the lock kit.

It is also to say that although the combination of parts being included in the lock kit provides the parts to fit all possible current combinations of common sizes of vinyl fence materials, market demands and price sensitivities may dictate that including all parts in the lock kit is not cost effective or desired by purchasers as other parts of the invention are readily available such as standard deadbolt locks and gate latches that can be affixed in a closed position by extension of the throw of the deadbolt lock.

Main Embodiments

Two Cups Embodiment.

The preferred embodiment of the invention employs two cups as shown on FIGS. 1, 3, 7, 8, 9, 10, 11, 12, 13A, 13B, 14, 16, 25A and 25B to install a deadbolt lock shown on FIG. 6 wherein the throw of the deadbolt lock inserts into a hole in either:

1. A gate latch as shown on FIGS. 3 and 13B, or over the gate latch if the gate latch is mounted upside down, or
2. A hole in a standoff receiver as shown on FIGS. 16, and 25B, or
3. A hole in an oval receiver such as that shown on FIGS. 23 and 24.

Single Cup Embodiment.

The second preferred embodiment of the invention employs a single cup for installation of a deadbolt lock as shown on FIGS. 26, 27, 28, and 29 wherein the throw of the deadbolt lock:

1. Extends and retracts under a gate latch as shown on FIGS. 29 or over the gate latch it the gate latch is mounted upside down, or
2. Inserts into a hole in an oval receiver such as that shown on FIGS. 23 and 24.

Installation of the 2 Cup Embodiment of the Invention in a Post.

Figure 3:
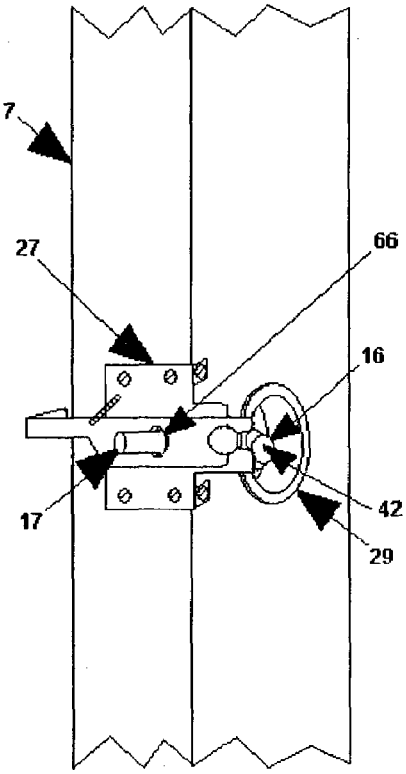
FIG. 3 shows the latch with hole installed on the vinyl post over the throw of the deadbolt lock.
Figure 16:
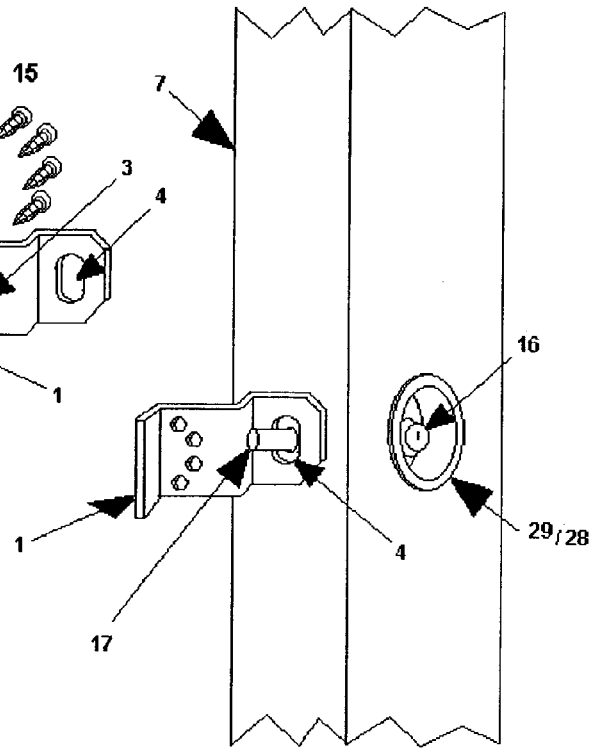
FIG. 16 shows a rear view of a vinyl post and the standoff receiver aligned with the throw of the deadbolt lock.

The first preferred embodiment of the invention (i.e. with two round cups) will be installed into a stationary fence post opposite a fence gate with a jaws latch with a hole as shown on FIGS. 3, 13A and 13B, or into a stationary fence post opposite a fence gate with a standoff receiver as shown on FIGS. 16, 25A, and 25B.

Description of Embodiments

Preferred Embodiment Using Round Cups. This embodiment is exemplified on FIGS. 1, 2, 3, 9, 16, 26, and 27 wherein round cups are used to install standard deadbolt locks into the round holes cut in a fence post; with the deadbolt lock face plate assemblies being attached to one another by use of threaded bolts to firmly hold the cups, deadbolt lock face plate assemblies in place allowing a deadbolt cylinder to be key operated to extend or retract the throw of the deadbolt lock through a hole in a gate latch or a hole in a standoff or oval receiver.

| Parts of Invention Shown on Drawings. | |
|---|---|
| 1. | Standoff Receiver |
| 2. | Center of Throw Hole |
| 3. | Screw Hole |
| 4. | Standoff Receiver Throw Hole |
| 6. | Screw |
| 7. | Vinyl Post |
| 8. | Extra Deep Cup |
| 9. | Opening in Front of Cup |
| 10. | Opening in Rear of Cup |
| 11. | Lip of Cup |
| 12. | Latch Without Hole |
| 13. | Latch Focrum |
| 14. | Latch Jaws |
| 15. | Latch Spring |
| 16. | Deadbolt Lock Face Plate Assembly |

-continued

| Parts of Invention Shown on Drawings. | |
|---|---|
| 17. | Throw of Deadbolt Lock |
| 18. | Handle of Latch |
| 19. | Threaded Deadbolt Lock Bolt |
| 20. | Deadbolt Cylinder Face Plate |
| 21. | Face Plate Gasket |
| 22. | Hole in Face Plate Gasket |
| 23. | Recessed Rim of Gasket |
| 24. | Assembled Face Plate and Gasket |
| 25. | Profile of Recessed Rim of Gasket |
| 26. | Key to Operate Deadbolt Latch |
| 27. | Latch with Hole |
| 28. | Deep Cup of 2 Cup Embodiment |
| 29. | Shallow Cup of 2 Cup Embodiment |
| 30. | 5 Inch by 5 Inch Vinyl Post |
| 31. | 4 Inch by 4 Inch Vinyl Post |
| 32. | Deadbolt Lock |
| 33. | Cutaway Profile of Cup |
| 34. | Tumbler Protrusion |
| 35. | Wall of Vinyl Post |
| 36. | Deadbolt Lock Cylinder |
| 37. | Position of Throw Through Hole in Latch |
| 38. | Latch Strike Bar Assembly |
| 39. | Latch Strike Bar |
| 40. | Latch Flange |
| 41. | Deadbolt Cylinder |
| 42. | Key Slot |
| 43. | Throw Operation Hole in Cylinder |
| 44. | Hole for Threaded Deadbolt Lock Bolt |
| 45. | Cylinder Hole |
| 46. | Cup Hole |
| 47. | Level |
| 52. | Wood Gate Cup |
| 53. | Gate Frame Board |
| 54. | Fence Board |
| 55. | Deadbolt Lock Hole |
| 56. | Fence Board Hole |
| 57. | Oval Throw Receiver |
| 58. | Oval Receiver Flange |
| 59. | Oval Receiver Throw Hole |
| 65. | Thumb Turn |
| 66. | Latch Hole |

DETAILED DESCRIPTION OF THE DRAWINGS

Figure 1:
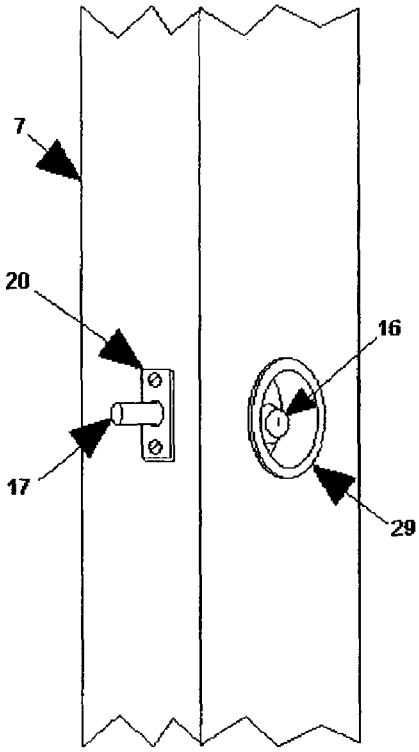
FIG. 1 shows a front view of a shallow cup installed in a vinyl post with the deadbolt lock face plate assembly and throw of a deadbolt lock showing.

FIG. 1 shows a front view of a vinyl post 7 with the shallow cup 29 installed in a vinyl post 7 with the deadbolt lock face plate assembly 16 of an installed deadbolt lock showing in the shallow cup 29 and a throw of a deadbolt lock 17 extending from the center of the deadbolt cylinder face plate 20 and is intended for use with FIG. 3 to explain the use and installation of a latch with hole.

Figure 2:
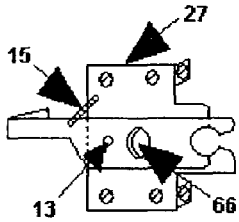
FIG. 2 shows a profile view of a latch with hole.

FIG. 2 shows a latch with hole 27 where a latch spring 15 aligns the latch hole 66 when pivoted by a latch focrum 13 and is intended for use with FIG. 3 to explain the use and installation of the latch with hole 27.

FIG. 3 shows the latch with hole 27 installed on the vinyl post 7 where the throw of the deadbolt lock 17 is extended through the latch hole 66 by use of a key inserted in the key slot 42 in the deadbolt lock face plate assembly 16; with said Deadbolt Lock Face Plate Assembly being installed in a shallow cup 29.

Figure 4:
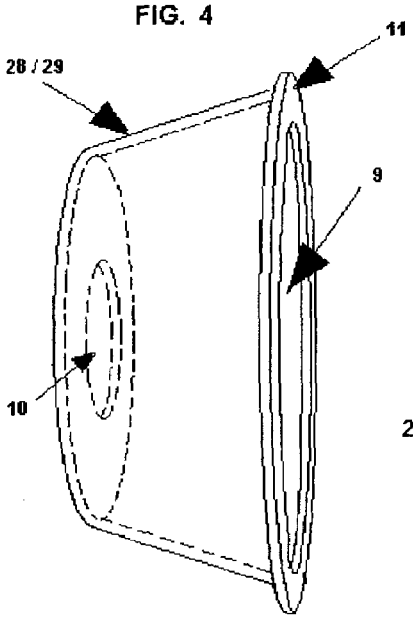
FIG. 4 shows the typical profile of the shallow and deep cups having a lip and having an opening in the rear of the cup.

FIG. 4 shows the design of the shallow cup 29 and the deep cup 28 having a opening in the rear of the cup 10 and an opening in the front of the cup 9 with the cups having a lip 11 to stop the cups from being pulled through the vinyl post.

Figure 5A:
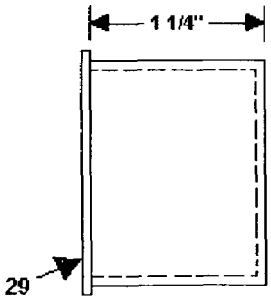
FIG. 5A shows the cutaway side view of the preferred depth of the shallow cup.

FIG. 5A shows the cutaway side view of the preferred depth of the shallow cup 29.

Figure 5B:
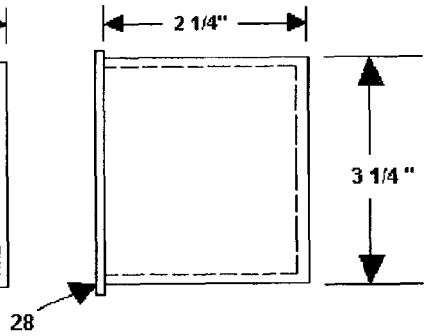
FIG. 5B shows the cutaway side view of the preferred depth of the deep cup and the preferred diameter of the shallow and deep cups.

FIG. 5B shows the cutaway side view of the preferred depth of the deep cup 28 as well as the preferred diameter of the shallow cup and the deep cup.

FIG. 6 shows a profile view of an assembled deadbolt lock 32 that is commonly available from such vendors as the Kwickset Corporation having a deadbolt lock face plate assembly 16 with a key slot 42 and a deadbolt lock cylinder 41 where from a throw of the deadbolt lock 17 is shown as projected into the deadbolt lock cylinder 41 through the deadbolt cylinder face plate 20 whereas said throw can be extended out of the deadbolt lock cylinder 41 through the deadbolt cylinder face plate 20 by the turning of an appropriate key in the key slot 42.

Figure 7:
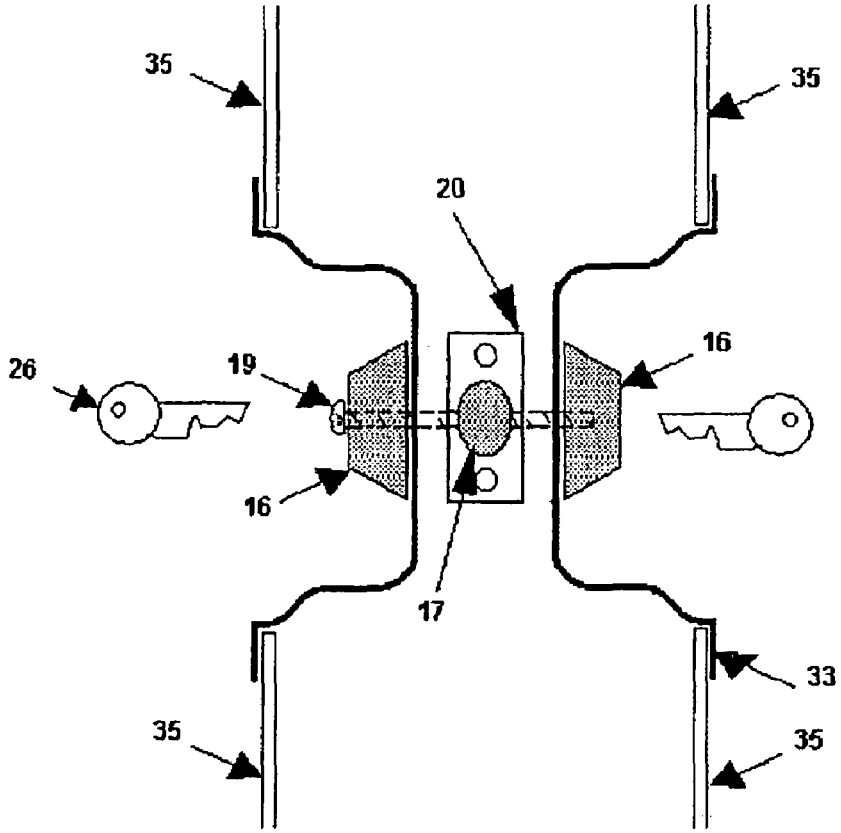
FIG. 7 shows a side cutaway profile view of selected components of the invented gate lock as a profile of the shallow cup when installed on the wall of a vinyl post.

FIG. 7 shows a side cutaway profile view of selected components of the invented gate lock as a profile of the shallow cup 33 when installed on the wall of a vinyl post 35 being held in place by a threaded deadbolt lock bolt 19 joining the opposing deadbolt lock face plate assemblies 16 and showing also the location of the deadbolt cylinder face plate 20 and the throw of the deadbolt lock 17 and indicating a key 26 to operate the deadbolt lock.

Figure 8:
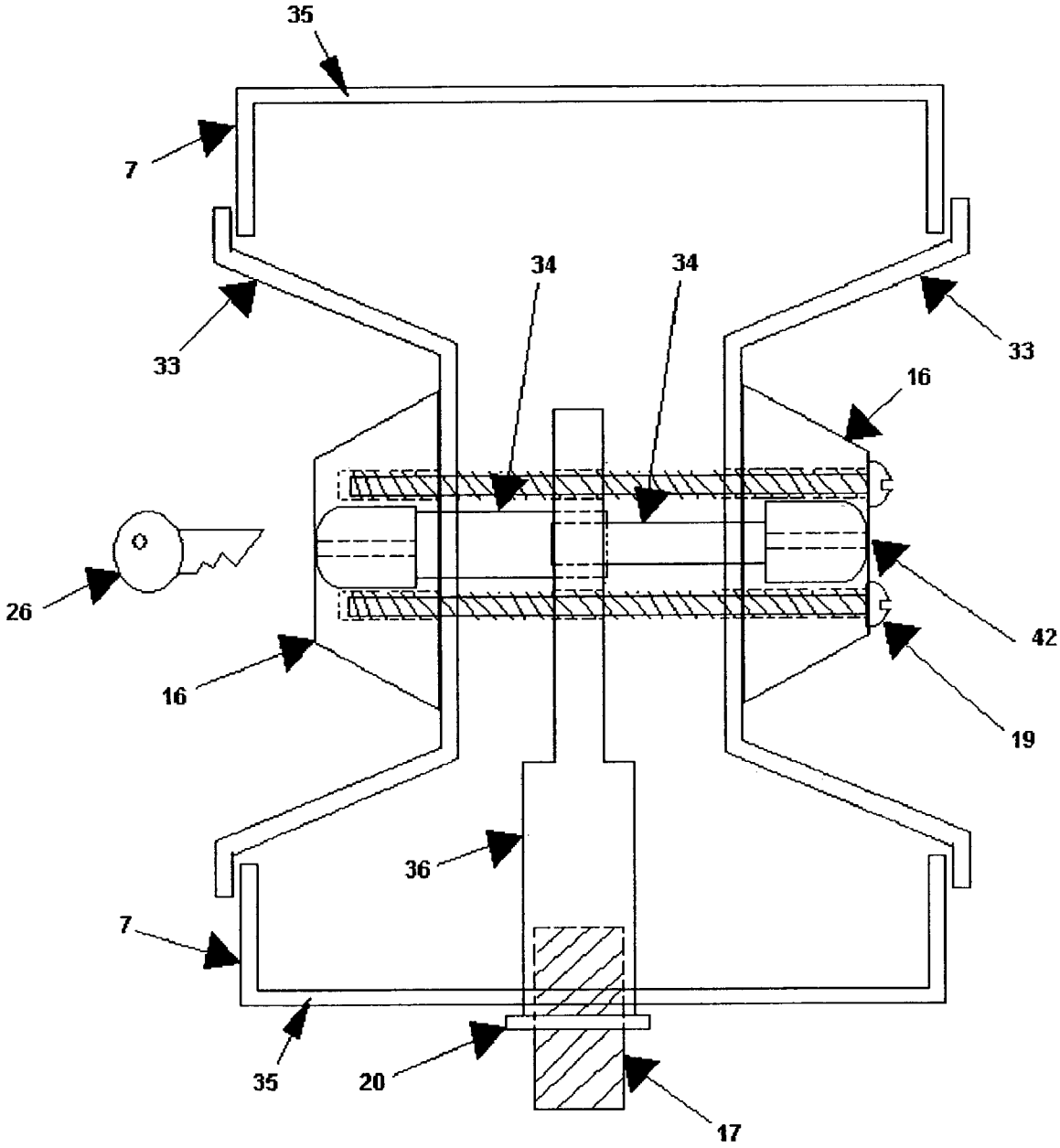
FIG. 8 shows a top cutaway profile view of select components of the invented gate lock where the top cutaway profile of a cup is shown installed into the walls of the vinyl post.

FIG. 8 shows a top cutaway profile view of select components of the invented gate lock installed in a vinyl post 7 where the top cutaway profile of a cup 33 is shown installed into the walls of the vinyl post 35 with the deadbolt lock face plate assemblies 16 is held in place by a threaded deadbolt lock bolt 19 with the tumbler protrusions 34 being nested together to make the deadbolt throw 17 that is in the deadbolt lock cylinder 36 made operable by a key 26 inserted into the key slot 42 of the deadbolt lock face plate assemblies 16.

Figure 9:
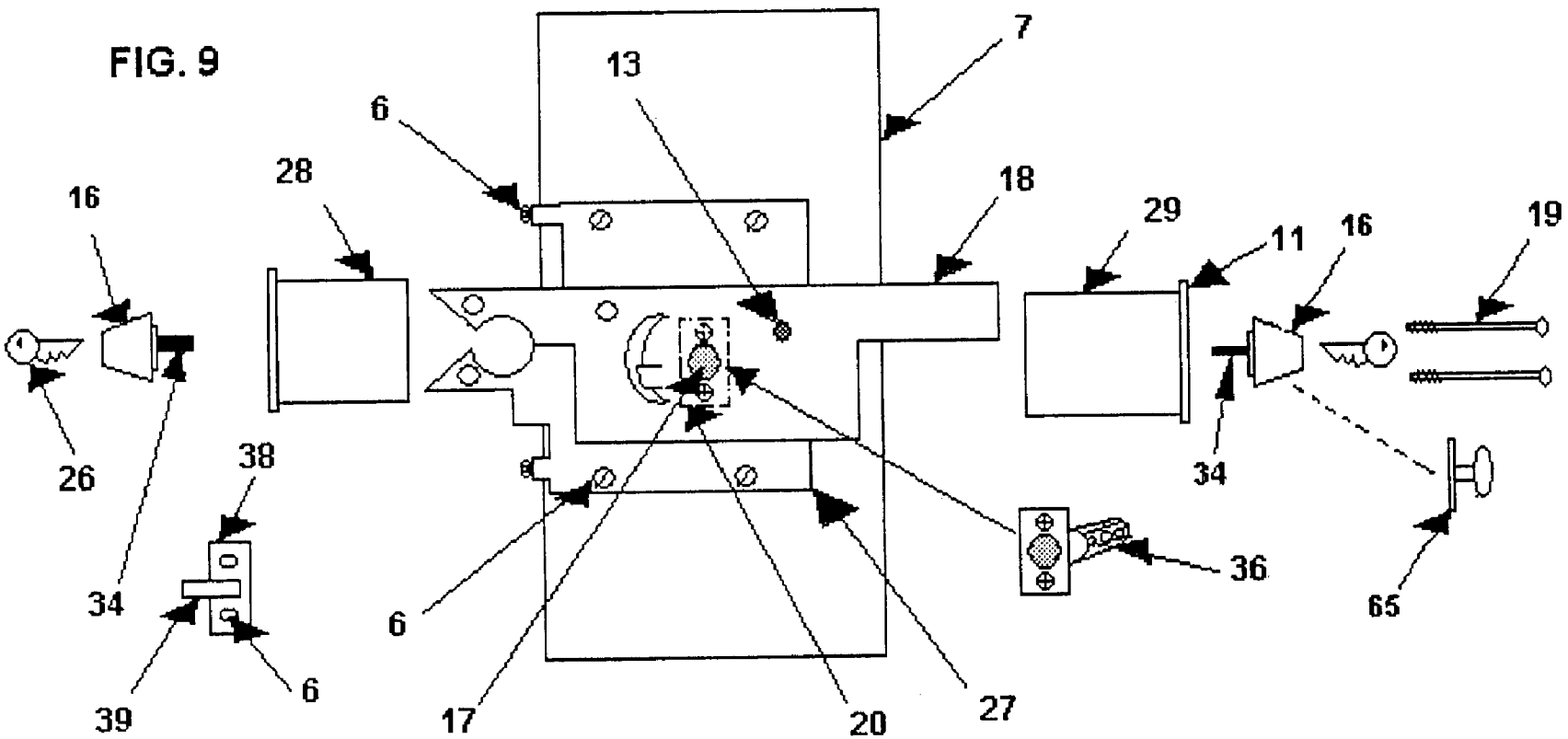
FIG. 9 shows an exploded side view of the parts of the invented gate lock with a latch with hole.

FIG. 9 shows an exploded side view of the parts of the invented gate lock where a vinyl post 7 that has been prepared by the drilling of holes at appropriate places can receive the shallow cup 29 and deep cup 28, both having lips 11 and deadbolt lock face plate assemblies 16 with tumbler protrusions 34 and a latch with hole 27 aligned with the deadbolt lock cylinder 36 with the latch being affixed with screws 6 and made operable by use of the handle of the latch 18 and with the deadbolt face plate assemblies 16 being held together by threaded deadbolt lock bolts 19 so that the deadbolt throw 17 can be extended and retracted through the latch with hole 27 by use of a key 26 or optionally a thumb turn 65.

Figure 10:
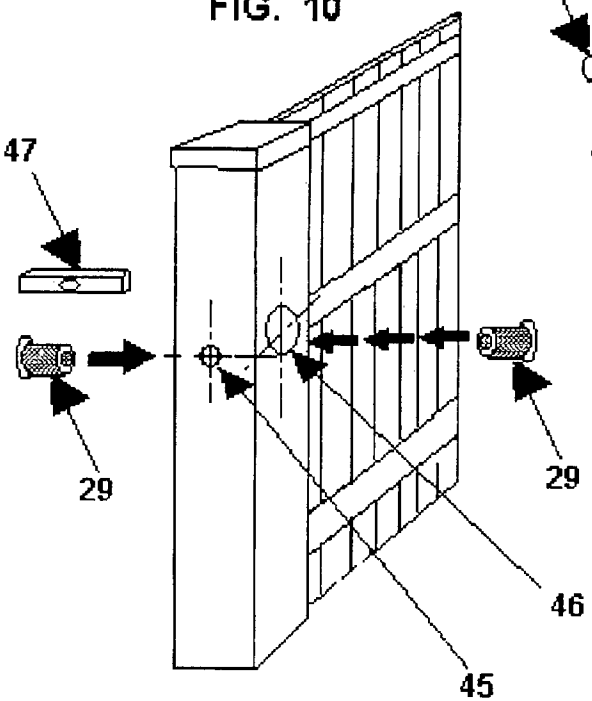
FIG. 10 shows a profile view of the proper preparation of a fence post where cup holes and a cylinder hole have been marked and drilled on opposite sides of the fence post.

FIG. 10 shows a profile view of the proper preparation of a fence post where cup holes 46 have been marked using a level 47 and drilled on opposite sides of the fence post and a cylinder hole 45 has been drilled on the right angle side of the vinyl post to make possible the installation of shallow cups 29 into the vinyl post.

Figure 11:
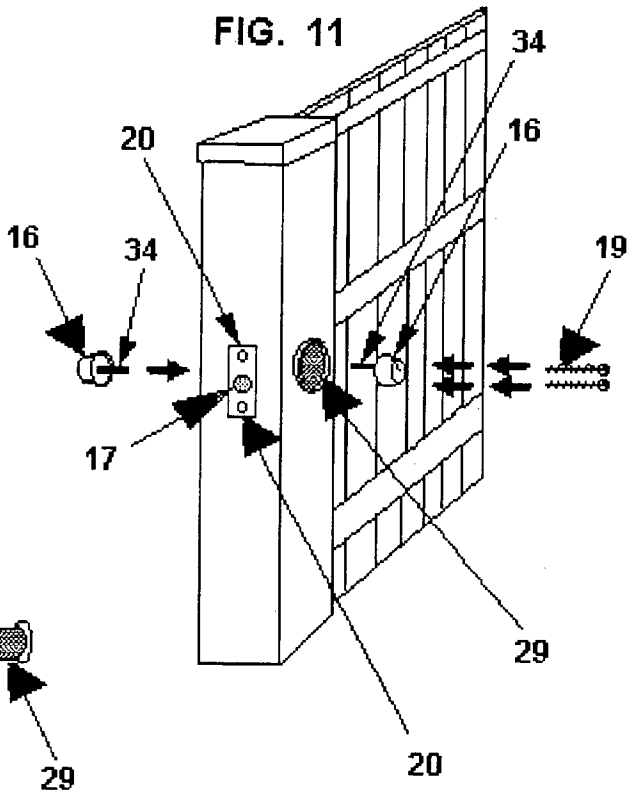
FIG. 11 shows a profile view of a fence post where shallow cups and the deadbolt cylinder face plate have been installed and the deadbolt lock face plate assemblies have been aligned to be installed.

FIG. 11 shows a profile view of a fence post where shallow cups 29 and the deadbolt cylinder face plate 20 have been installed and the deadbolt lock face plate assemblies 16 with tumbler protrusions 34 have been aligned to be installed into the shallow cups 29 and affixed using the threaded deadbolt lock bolt 19.

Figure 12:
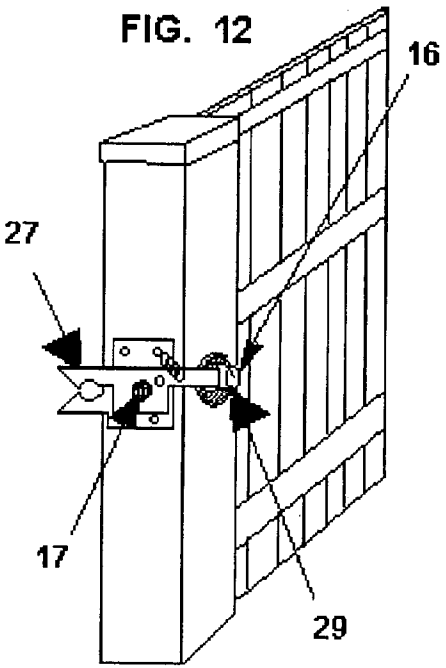
FIG. 12 shows a profile view of an assembled lock parts with the latch with hole installed aligned with the latch with hole.

FIG. 12 shows a profile view of an assembled lock parts where the latch with hole 27 has been aligned with the shallow cups 29 and installed so that the throw of the deadbolt lock 17 can be extended through the latch with hole 27.

FIG. 13A shows steps 1 to Step 5 of the instructions for installing the invented gate lock with a latch with a hole.

FIG. 13B shows steps 6 to Step 10 of the instructions for installing the invented gate lock with a latch with a hole.

Figure 14:
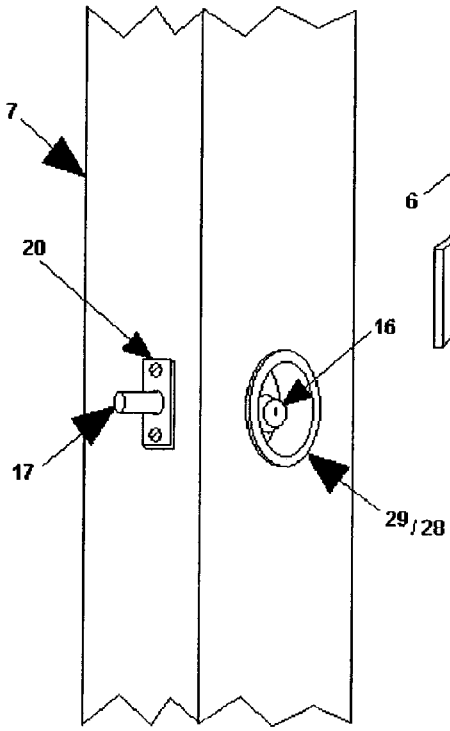
FIG. 14 shows a rear view of a vinyl post with a shallow cup with the deadbolt lock face plate assembly and throw of the deadbolt showing.
Figure 21:
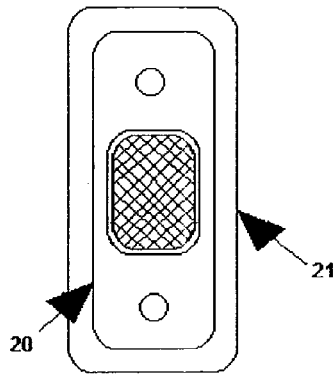
FIG. 21 shows the deadbolt cylinder face plate installed in the face plate gasket.

FIG. 14 shows a rear view of a vinyl post 7 and a shallow cup 29 installed in the vinyl post 7 with the deadbolt lock face plate assembly 16 of an installed deadbolt lock showing in a shallow cup 29 or deep cup 28 and a deadbolt throw 17 extending from the center of the deadbolt cylinder face plate 20 and is intended for use with FIG. 21 to explain the use and installation of a standoff receiver.

Figure 15:
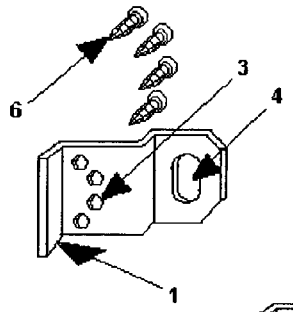
FIG. 15 shows a rear profile view of a standoff receiver.

FIG. 15 shows a rear profile view of a standoff receiver 1 that has a standoff receiver throw hole 4 to be aligned with a deadbolt lock throw and to be fastened to an opposing vinyl post with screws 6 going through screw holes 3 and is intended for use with FIG. 21 to explain the use and installation of a standoff receiver 1.

FIG. 16 shows a rear view of a vinyl post 7 and the standoff receiver 1 with the standoff receiver throw hole 4 over the deadbolt lock throw 17 that extends from the side of the vinyl post 7 and showing a shallow cup 29 or deep cup 28 and a Deadbolt Lock Face Plate Assembly 16 in the installed cup.

Figure 17:
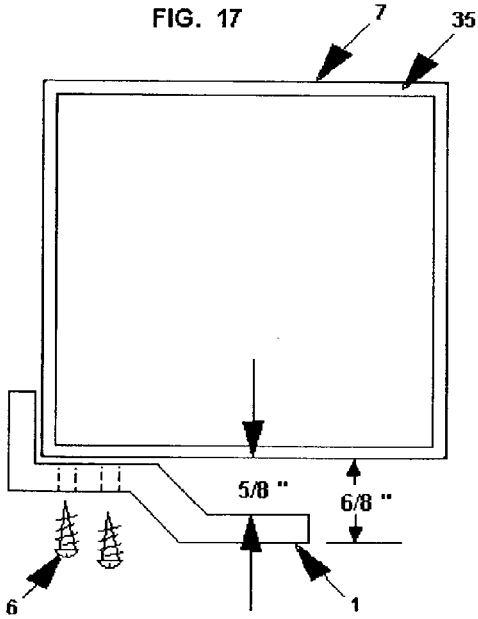
FIG. 17 shows a top view of the preferred measurements of the vinyl post with a standoff receiver.

FIG. 17 shows a top view of the preferred measurements of the combination of a vinyl post 7 with a standoff receiver 1 to be held in place by screws 6 penetrating the wall of the vinyl post 35.

Figure 18:
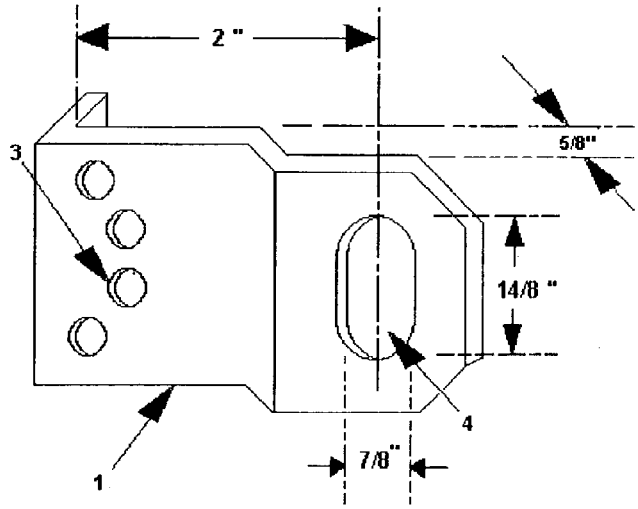
FIG. 18 shows a front profile view of the preferred measurements of the standoff receiver.

FIG. 18 shows a front profile view of the preferred measurements of the standoff receiver 1 having screw holes 3 and having a standoff receiver throw hole 4.

Figure 19:
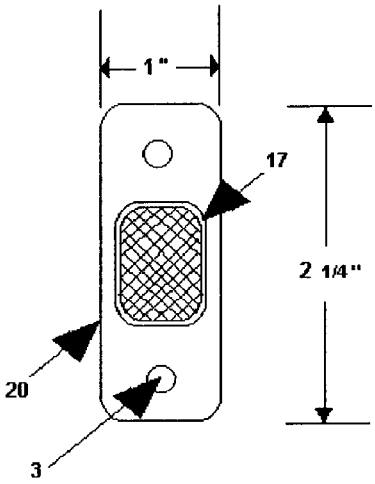
FIG. 19 shows preferred size measurements of a front view of the deadbolt cylinder face plate.

FIG. 19 shows preferred size measurements of a front view of the deadbolt cylinder face plate 20 with screw holes 3 and showing the surface of the deadbolt lock throw 17.

Figure 20:
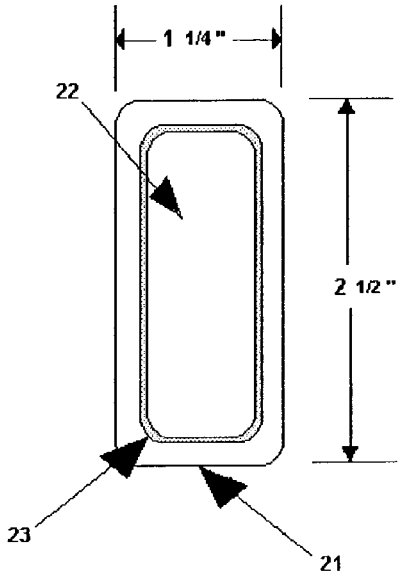
FIG. 20 shows preferred size measurements of the face plate gasket.

FIG. 20 shows preferred size measurements of the face plate gasket 21 having a recessed rim of the gasket 23 and a hole in the face plate gasket 22.

FIG. 21 shows the deadbolt cylinder face plate 20 installed in the face plate gasket 21.

Figure 22:
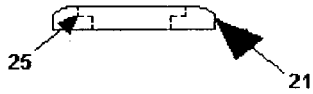
FIG. 22 shows a side view of the profile of the recessed rim of the face plate gasket.

FIG. 22 shows a side view of the profile of the recessed rim 25 of the face plate gasket 21.

Figure 23:
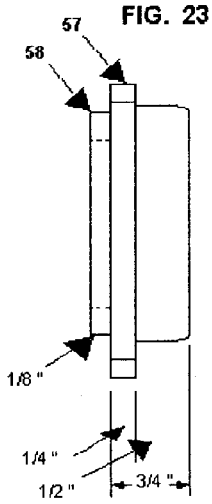
FIG. 23 shows a side view of the preferred measurements of an oval throw receiver.

FIG. 23 shows a side view of the preferred measurements of an oval throw receiver 57 that could be used in place of a standoff receiver with said oval throw receiver possibly having a oval receiver flange 58.

Figure 24:
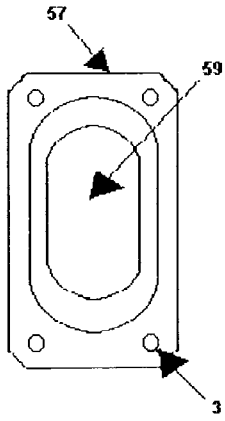
FIG. 24 shows a front view of the oval throw receiver.

FIG. 24 shows a front view of the oval throw receiver 57 with screw holes 3 and an oval receiver throw hole 59 in the center of said oval throw receiver.

FIG. 25A shows Step 1 to Step 4 of typical installation instructions for the embodiment of the invented lock that uses a standoff receiver as a means to affix a gate to an opposing fence post.

FIG. 25B shows Step 5 to Step 9 of typical installation instructions for the embodiment of the invented lock that uses a standoff receiver as a means to affix a gate to an opposing fence post.

Figure 26:
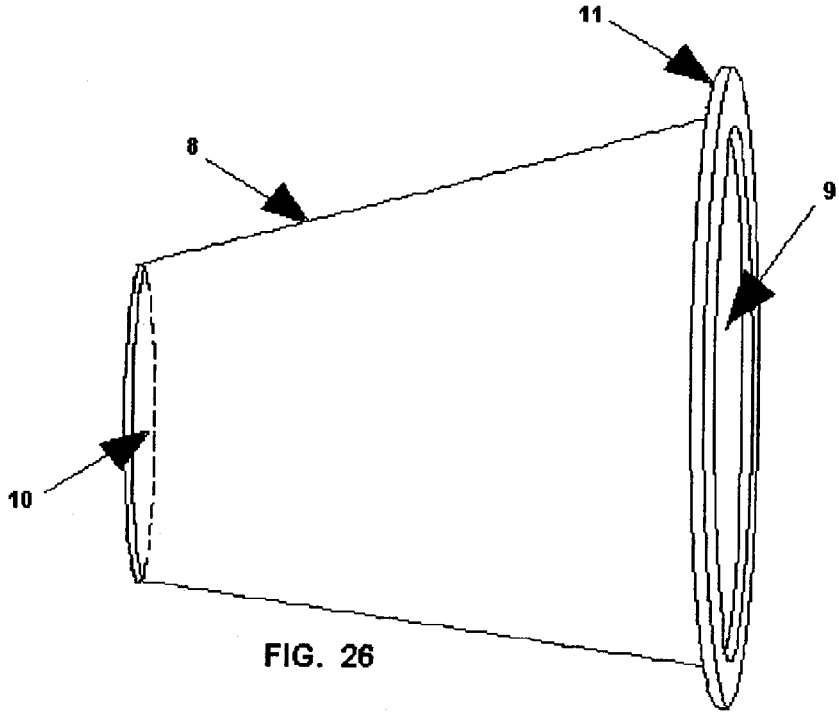
FIG. 26 shows a profile view of an extra deep cup having a lip.

FIG. 26 shows a profile view of an extra deep cup 8 having a lip of cup 11 and a opening in the rear of the cup 10 sized to receive a the rim of a Deadbolt Lock Face Plate Assembly and an opening in the front of the cup 9.

Figure 27:
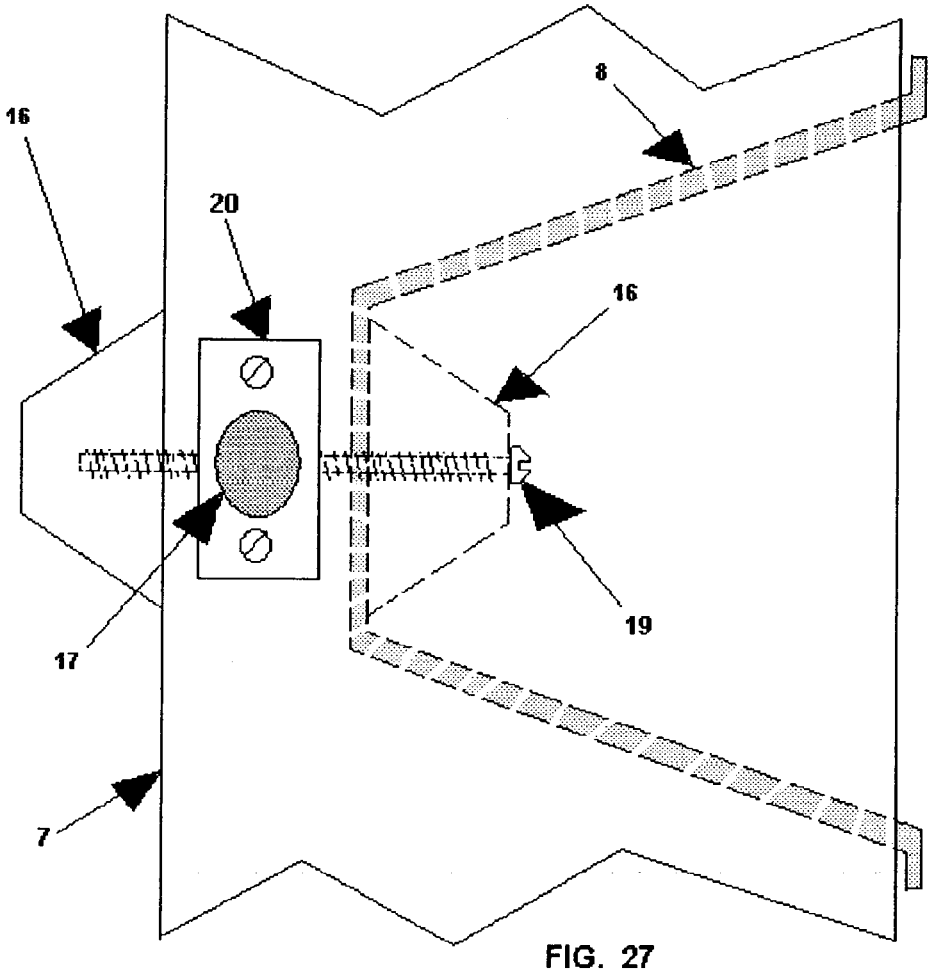
FIG. 27 shows a side view of the position of the extra deep cup installed in a vinyl post along with deadbolt face plate assemblies.

FIG. 27 shows a side view of the position of the extra deep cup 8 installed in a vinyl post 7 along with deadbolt face plate assemblies 16 installed in the cup and on the face of said vinyl post said deadbolt face plates being held together by threaded deadbolt lock bolts 19 and having a deadbolt cylinder face plate 20 aligned to allow the throw of the deadbolt lock 17 to extend from said vinyl post.

Figure 28:
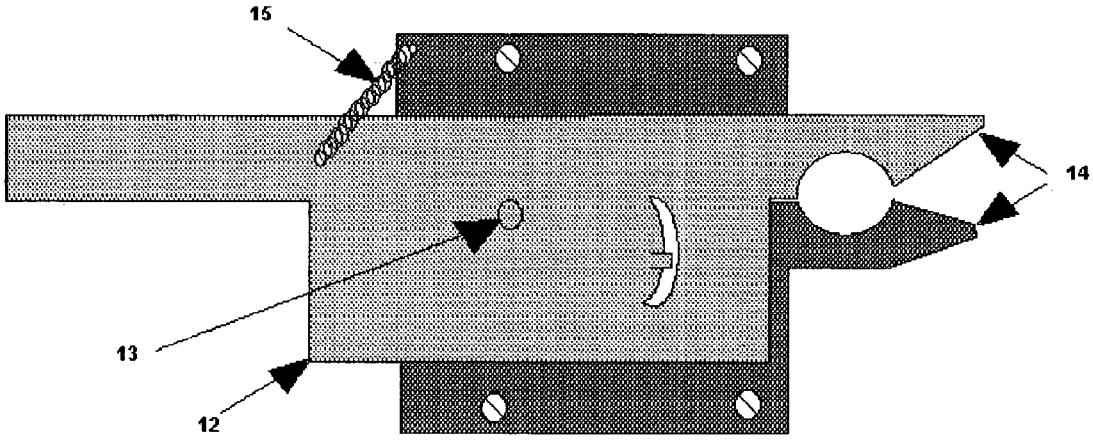
FIG. 28 shows a side view of the latch without hole.

FIG. 28 shows a side view of the latch without hole 12 having a latch focrum 13 and a latch spring 15 that allow the latch jaws 14 to be separated to unlock a gate.

Figure 29:
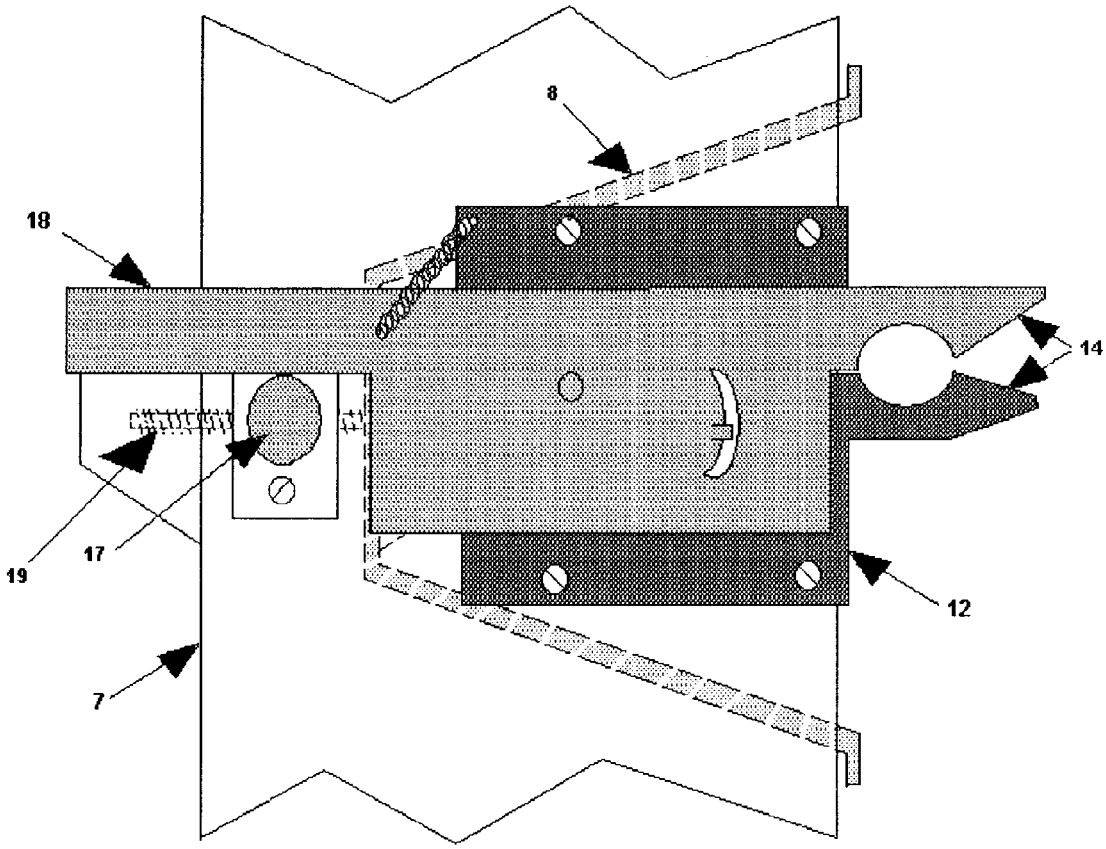
FIG. 29 shows the latch without hole and extra deep cup installed on a vinyl post.
Figure 30:
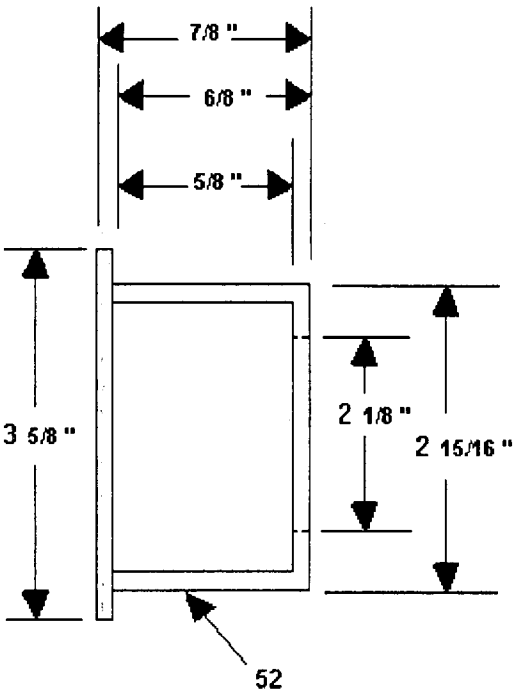
FIG. 30 shows the preferred measurements of a circularly shaped wood gate cup.

FIG. 29 shows the latch without hole 12 and an extra deep cup 8 installed on a vinyl post 7 with the throw of the deadbolt lock 17 positioned to stop the handle of the latch 18 to be significantly moved to separate the latch jaws 14 when the throw of the deadbolt lock 17 is extended from the vinyl post 7 and with deadbolt face plate assemblies being held together by threaded deadbolt lock bolts 19 FIG. 30 shows the preferred measurements of a wood gate cup 52 that is circularly shaped.

FIG. 30 shows the preferred measurements of a wood gate cup 52 that is circularly shaped.

Figure 31:
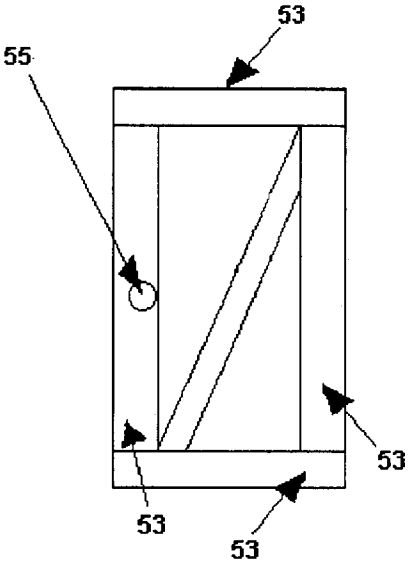
FIG. 31 shows a rear view of gate frame boards with a deadbolt lock hole.

FIG. 31 shows a rear view of gate frame boards 53 with a deadbolt lock hole 55.

Figure 32:
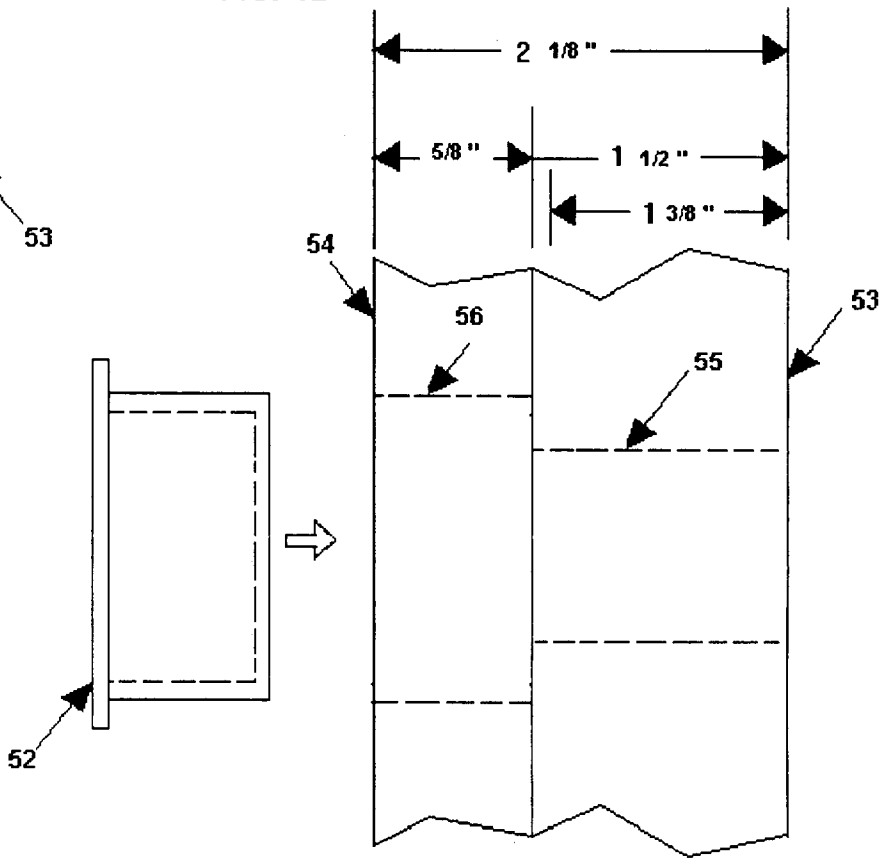
FIG. 32 shows a side view of a wood gate cup that will be inserted into a fence board hole that is on center with a deadbolt lock hole.

FIG. 32 shows a side view of a wood gate cup 52 that will be inserted into a fence board hole 56 that is on center with a deadbolt lock hole 55 with the said fence board hole 56 drilled in a fence board 54 and the deadlbolt lock hole 55 drilled in the gate frame board 53.

FIG. 33 shows a side view of parts of the invented wood gate lock where a wood gate cup 52 is installed into a fence board hole 56 in a fence board 54 over a deadbolt lock hole 55 in a gate frame board 53 where deadbolt lock face plate assemblies 16 having rear tumbler protrusions 34 are nested together in the deadbolt cylinder (not shown) to effectuate the operation of the deadbolt lock.

FIG. 34 shows the typical installation instructions for the invented wood gate lock.

All measurements disclosed herein are at standard temperature and pressure, at sea level on Earth, unless indicated otherwise. All materials used or intended to be used in a human being are biocompatible, unless indicated otherwise. The foregoing embodiments are presented by way of example only; the scope of the present invention is to be limited only by the following claims.

The inventors seek patent protection for the following combination of the invented system of parts. What is claimed by the inventor as being a new, innovative, and not obvious use and desired to be protected by Letters Patent of the United States is as follows:

The invention claimed is:

1. A vinyl gated fence, comprising:

a) a vinyl fence with vinyl fence sections and vinyl fence posts, each fence post being a hollow post having four outer post walls surrounding a post interior, each post wall having an outer surface, an inner surface and wherein two of said post walls are opposing walls having an aperture;

b) a gate mounted on the fence in between two of said fence posts;

c) a locking mechanism that enables the gate to be locked;

d) wherein the locking mechanism includes a dead bolt lock and a pair of cups, each cup mounted in an aperture of a post wall, each aperture having a cup;

e) each cup having an annular flange that abuts an outer surface of a post wall, wherein the cups are positioned at about the same elevation and on opposing, generally parallel post walls of a post;

f) each cup having an annular side wall forming a concavity extending into a post interior, said annular side wall connected to said annular flange;

g) the concavity of each cup having a front opening surrounded by said annular flange;

h) wherein said cups are connected with said dead bolt lock, said dead bolt lock connecting to each of said cups at positions within the post interior and spaced inwardly of the post walls; and i) said lock providing a throw that is movable between locked and unlocked positions.

2. The vinyl gated fence of claim 1 wherein the annular side wall is generally cylindrically shaped.

3. The vinyl gated fence of claim 1 wherein the annular side wall is generally frustoconically shaped.

4. The vinyl gated fence of claim 1 wherein the annular side wall is tapered.

5. The vinyl gated fence of claim 1 wherein each cup is generally frustoconically shaped.

6. The vinyl gated fence of claim 1 wherein the cups include a deep cup and a shallow cup.

7. The vinyl gated fence of claim 1 wherein the dead bolt lock has a maximum dimension that is smaller than the post thickness.

8. The vinyl gated fence of claim 1 wherein at least one of the cups provides a rear opening.

9. The vinyl gated fence of claim 1 wherein each of the cups provides a rear opening.

10. A vinyl gated fence, comprising:

a) a vinyl fence that includes spaced apart vinyl fence posts connected by vinyl fence sections and at least one vinyl gate, each fence post being a hollow post having four outer post walls surrounding a post interior, each post wall having an outer surface, an inner surface and wherein two of said post walls are opposing walls having an aperture;

b) said gate mounted on the fence in between two of said fence posts;

c) a locking mechanism that enables the gate to be locked;

d) wherein the locking mechanism includes a pair of cups, each cup mounted in an aperture of a post wall, each aperture having a cup;

e) each cup having an annular flange that abuts an outer surface of a post wall, wherein the cups are positioned at about the same elevation and on opposing, generally parallel post walls of a post;

f) each cup having an annular side wall forming a concavity, said annular side wall connected to said annular flange;

g) the concavity of each cup having a front opening surrounded by said annular flange;

h) wherein said cups are connected with a lock that is a part of the locking mechanism, said lock extending to and connecting said cups, wherein the maximum dimension of the lock is less than the maximum spacing between said opposing post walls; and i) said lock providing a throw that is movable between locked and unlocked positions.

11. The vinyl gated fence of claim 10 wherein the annular side wall is generally cylindrically shaped.

12. The vinyl gated fence of claim 10 wherein the annular side wall is generally frustoconically shaped.

13. The vinyl gated fence of claim 10 wherein the annular side wall is tapered.

14. The vinyl gated fence of claim 10 wherein each cup is generally frustoconically shaped.

15. The vinyl gated fence of claim 10 wherein the cups include a deep cup and a shallow cup.

16. The vinyl gated fence of claim 10 wherein the lock has a maximum dimension that is smaller than the post thickness.

17. The vinyl gated fence of claim 10 wherein at least one of the cups provides a rear opening.

18. The vinyl gated fence of claim 10 wherein each of the cups provides a rear opening.

* * * * *